US005957104A

United States Patent [19]

Ohsawa

[11] Patent Number: 5,957,104

[45] Date of Patent: Sep. 28, 1999

[54] CYLINDER HEAD STRUCTURE OF AN INTERNAL COMBUSTION ENGINE

[75] Inventor: Hiroshi Ohsawa, Shizuoka-ken, Japan

[73] Assignee: Suzuki Motor Corporation, Shizuoka-ken, Japan

[21] Appl. No.: 09/073,611

[22] Filed: May 6, 1998

[30] Foreign Application Priority Data

May 29, 1997 [JP] Japan ..... 9-155922

[51] Int. Cl.[6] ..... F02F 1/24

[52] U.S. Cl. ..... 123/193.5

[58] Field of Search ..... 123/193.5, 90.48, 123/90.27, 195 R

[56] References Cited

U.S. PATENT DOCUMENTS

| | | | |
|---|---|---|---|
| 5,531,194 | 7/1996 | Komatsu et al. . | |
| 5,535,714 | 7/1996 | Aoyama et al. | 123/193.5 |
| 5,609,129 | 3/1997 | Hauf et al. | 123/193.5 |
| 5,845,616 | 12/1998 | Schwarzenthal et al. | 123/193.5 |
| 5,875,754 | 3/1999 | Ickinger | 123/193.5 |
| 5,906,186 | 5/1999 | Aoyama et al. | 123/90.48 |

FOREIGN PATENT DOCUMENTS

| | | |
|---|---|---|
| 2-81919 | 3/1990 | Japan . |
| 7-63118 | 3/1995 | Japan . |
| 7-305652 | 11/1995 | Japan . |

*Primary Examiner*—Marguerite McMahon
*Attorney, Agent, or Firm*—Flynn, Thiel, Boutell & Tanis, P.C.

[57] ABSTRACT

A cylinder head structure of an internal combustion engine which permits shortening of the overall length of the engine, provides a reduction in the exhaust-side width of the engine making the engine compact, and enables formation of intake ports in a rectilinear shape, all of which are advantageous with respect to both performance of the engine and layout of an intake manifold. The cylinder head structure includes intake-side bolt boss portions and exhaust-side bolt boss portions formed adjacently on both sides of intake-side tappet boss portions and exhaust-side tappet boss portions in a crank axis direction, respectively, the intake-side tappet boss portions being positioned outside the intake-side bolt boss portions in the transverse direction of the cylinder head, and the exhaust-side tappet boss portions being positioned inside the exhaust-side bolt boss portions transversely of the cylinder head.

6 Claims, 5 Drawing Sheets

CYLINDER HEAD STRUCTURE OF AN INTERNAL COMBUSTION ENGINE

FIELD OF THE INVENTION

The present invention relates to a cylinder head structure of an internal combustion engine. Particularly, the invention is concerned with a cylinder head structure of an internal combustion engine which can contribute to shortening the overall length of the internal combustion engine, reducing the exhaust-side width of the engine, making the engine compact, and forming intake ports in a rectilinear shape and which can be advantageous with regard to performance of the engine and layout of an intake manifold.

BACKGROUND OF THE INVENTION

In an internal combustion engine mounted on a vehicle or the like, a cylinder head is attached to a cylinder block, and a cylinder head cover is attached to the cylinder head. In the cylinder head, intake ports and exhaust ports are formed which communicate with a combustion chamber, and intake and exhaust valves are mounted for opening and closing the intake and exhaust ports, respectively.

According to one conventional type of internal combustion engine, intake-side tappet boss portions and exhaust-side tappet boss portions are formed in the cylinder head, and the intake and exhaust-side tappet boss portions axially movably support intake tappets for the intake valves and exhaust tappets for the exhaust valves, respectively. Intake-side bolt boss portions and exhaust-side bolt boss portions are also formed in the cylinder head, into which intake-side head bolts and exhaust-side head bolts are inserted respectively. The intake and exhaust-side bolt boss portions are adjacently positioned respectively on both sides of the intake-side tappet boss portions and the exhaust-side tappet boss portions in an axial direction of a crankshaft of the engine.

FIGS. 4 and 5 illustrate two such conventional cylinder head structures.

In FIG. 4, the numeral 102 denotes a cylinder head of an internal combustion engine (not shown). In the cylinder head 102, intake-side tappet boss portions 104 and exhaust-side tappet boss portions 106 are formed, and intake-side bolt boss portions 108 and exhaust-side bolt boss portions 110 are also adjacently formed respectively on both sides of the intake-side tappet boss portions 104 and the exhaust-side tappet boss portions 106 in the direction of crank axis L1. Intake-side tappet holes 112 and exhaust-side tappet holes 114 are formed in the intake-side tappet boss portions 104 and the exhaust-side tappet boss portions 106, respectively. The intake-side tappet holes 112 and exhaust-side tappet holes 114 axially movably support intake tappets and exhaust tappets for intake valves and exhaust valves which open and close intake ports and exhaust ports, respectively, (not shown). Intake-side bolt insertion holes 116 and exhaust-side bolt insertion holes 118 are formed in the intake-side bolt boss portions 108 and the exhaust-side bolt boss portions 110, respectively, into which insertion holes 116 and 118 are inserted intake-side head bolts and exhaust-side head bolts, respectively, for mounting the cylinder head 102 to a cylinder block (not shown).

In the cylinder head 102, the centerline-to-centerline spacings BP (bolt pitch) between the intake-side bolt boss portions 108 and between the exhaust-side bolt boss portions 110 are small, and innermost edge distances B between the intake-side bolt boss portions 108 and between the exhaust-side bolt boss portions 110 are smaller than outermost edge distances A between the intake-side tappet boss portions 104 and between the exhaust-side tappet boss portions 106 (i.e. A>B). D (in FIGS. 4 and 5) represents the diameter of the intake-side bolt boss portions 108 and the exhaust-side bolt boss portions 110, and thus B=BP−D.

In the cylinder head 102, therefore, if an axis L2 joining the centers of the intake-side tappet boss portions 104 and an axis L4 joining the centers of the intake-side bolt boss portions 108 are positioned coaxially with one another and in parallel with the crank axis L1, and likewise if an axis L3 joining the centers of the exhaust-side tappet boss portions 106 and an axis L5 joining the centers of the exhaust-side bolt boss portions 110 are positioned coaxially with one another and in parallel with the crank axis L1, the intake-side tappet holes 112 and the intake-side bolt insertion holes 116 interfere with each other, and likewise the exhaust-side tappet holes 114 and the exhaust-side bolt insertion holes 118 interfere with each other. To avoid such interference, in the cylinder head 102, the axes L2 and L3 are positioned inside the axes L4 and L5, respectively, in a direction transverse to the direction of the crank axis L1 so that the intake-side tappet boss portions 104 and the exhaust-side tappet boss portions 106 are positioned inside the intake-side bolt boss portions 108 and the exhaust-side bolt boss portions 110, respectively, in the transverse direction.

On the other hand, in the conventional cylinder head 102 shown in FIG. 5, the spacings BP between the intake-side bolt boss portions 108 and between the exhaust-side bolt boss portions 110 are small, so an axis L2 joining the centers of intake-side tappet holes 112 is positioned outside an axis L4 joining the centers of intake-side bolt insertion holes 116 in a direction transverse to the direction of crank axis L1, and likewise an axis L3 joining the centers of exhaust-side tappet holes 114 is positioned outside an axis L5 joining the centers of exhaust-side bolt insertion holes 118 in a direction transverse to the direction of crank axis L1. Consequently, intake-side tappet boss portions 104 are positioned outside intake-side bolt boss portions 108 in the transverse direction, and exhaust-side tappet boss portions 106 are positioned outside exhaust-side bolt boss portions 110 in the transverse direction, to avoid interference.

Certain types of internal combustion engines have what are called top entry ports (TEP); that is, intake ports which communicate with a combustion chamber and open in the upper surface of a cylinder head. This type of cylinder head for an internal combustion engine, as discussed above, includes intake-side tappet boss portions and exhaust-side tappet boss portions, and intake-side bolt boss portions and exhaust-side bolt boss portions adjacently located on both sides of the intake and exhaust-side tappet boss portions, respectively, in a crank axis direction.

Such cylinder head structures of internal combustion engines are disclosed in Japanese Patent Laid-Open Nos. 2-81919, 7-63118 and 7-305652.

According to the cylinder head structure disclosed in Japanese Patent Laid-Open No. 2-81919, intake valve ports and exhaust valve ports are formed in a head block of each cylinder along the axis of a crankshaft, and at least one of the intake ports and exhaust ports extending from those valve ports are drawn out upwardly.

According to the cylinder head structure disclosed in Japanese Patent Laid-Open No. 7-63118, both intake and exhaust ports are opened in one side wall portion of a cylinder head so that the intake ports are positioned above and in parallel with the exhaust ports, and stem portions of the exhaust valves are passed through both exhaust and intake ports.

According to the cylinder head structure disclosed in Japanese Patent Laid-Open No. 7-305652, a combustion chamber is formed on the bottom of a cylinder head, and intake and exhaust passages are formed in the cylinder head so as to open at one end into the combustion chamber, the opposite end of each of the intake passages opening at the upper surface of the cylinder head, and the opposite end of each of the exhaust passages opening at the bottom of the cylinder head.

In internal combustion engines provided with a cylinder head having so-called top entry ports (TEP) as intake ports formed in the upper surface of the cylinder head which communicate with a combustion chamber, as referred to above, if the head bolt pitch in the cylinder block is set small with a view to shortening the overall length of the internal combustion engine, it becomes difficult to ensure a space for the formation of an intake port in the upper surface of the cylinder head. On the other hand, if an attempt is made to ensure a space for the formation of an intake port in the upper surface of the cylinder head, such an attempt brings about a disadvantage from the standpoint of both space and weight.

For example, as shown in FIG. 4, in the cylinder head 102 wherein the intake and exhaust-side tappet boss portions 104 and 106 are respectively positioned inside the intake and exhaust-side bolt boss portions 108 and 110 in the transverse direction, an upper surface 120 of the cylinder head located between the intake and exhaust-side tappet boss portions 104 and 106 is narrow, and a spark plug hole 122 occupies this space, so that it is difficult to ensure a space for the formation of intake ports.

On the other hand, in the cylinder head 102 shown in FIG. 5 wherein the intake and exhaust-side tappet boss portions 104, 106 are respectively positioned outside the intake and exhaust-side bolt boss portions 108, 110 in the transverse direction, the upper surface 120 of the cylinder head located between the intake and exhaust-side tappet boss portions 104 and 106 is wide, so that it is possible to ensure the space for the formation of intake ports. In this case, however, the width of the cylinder head 102 itself becomes large, which is disadvantageous from the standpoint of both space and weight.

If priority is given to ensuring a space for the formation of intake ports despite the disadvantage in both space and weight, taking into account the point that the space of engine room is to be narrowed and the point that fuel economy of the internal combustion engine is to be attained, and if along this intention there are formed intake ports in the upper surface 120 of the cylinder head 102 shown in FIG. 4, the internal combustion engine can be rendered compact and at the same time it is possible to form intake ports, but the shape of the intake ports is restricted due to interference with the intake and exhaust-side tappet boss portions 104 and 106 and it becomes difficult to introduce air into the combustion chamber, which is disadvantageous to the performance of the internal combustion engine. Additionally, it becomes difficult to ensure a mounting space of an intake manifold, and a restriction is imposed on the layout of the intake manifold.

SUMMARY OF THE INVENTION

According to the present invention, in order to eliminate or minimize the above-mentioned drawbacks, there is provided a cylinder head structure of an internal combustion engine including intake ports opening in an upper surface of a cylinder head which are in communication with a combustion chamber, and exhaust ports opening in a side face of the cylinder head which are in communication with the combustion chamber. Intake valves and exhaust valves are mounted in the cylinder head for opening and closing the intake ports and the exhaust ports, respectively. Intake-side tappet boss portions and exhaust-side tappet boss portions are formed in the cylinder head, whereby the intake-side tappet boss portions and the exhaust-side tappet boss portions axially movably support intake tappets and exhaust tappets for the intake valves and the exhaust valves, respectively. Intake-side bolt boss portions and exhaust-side bolt boss portions are also formed in the cylinder head, into which bolt boss portions are inserted intake-side head bolts and exhaust-side head bolts, respectively. The intake-side bolt boss portions and the exhaust-side bolt boss portions are adjacently positioned respectively on both sides of the intake-side tappet boss portions and the exhaust-side tappet boss portions in an axial direction of a crankshaft.

The intake-side tappet boss portions are positioned outside in the transverse direction (i.e. a direction transverse to the crank axis) of the cylinder head with respect to the intake-side bolt boss portions, and the exhaust-side tappet boss portions are positioned inside in the transverse direction of the cylinder head with respect to the exhaust-side bolt boss portions. Further, in the cylinder head, the angle of each intake valve relative to a cylinder axis in the internal combustion engine is larger than the angle of each exhaust valve relative to the cylinder axis.

In the cylinder head structure of an internal combustion engine according to the present invention, intake-side tappet boss portions are positioned outside intake-side bolt boss portions in the transverse direction of the cylinder head, while exhaust-side tappet boss portions are positioned inside exhaust-side bolt boss portions in the transverse direction of the cylinder head, whereby it is possible to ensure a space for forming intake ports in the upper surface of the cylinder head while narrowing the head bolt pitch. Thus, it is possible to easily ensure a mounting space of an intake manifold. Further, in the cylinder head structure according to the present invention, while intake-side tappet boss portions are positioned outside intake-side bolt boss portions in the transverse direction of the cylinder head to ensure a space for forming intake ports in the upper surface of the cylinder head, the angle of each intake valve relative to the cylinder axis in the engine is set larger than the angle of each exhaust valve relative to the cylinder axis, whereby the layout of intake ports becomes easy because of large tilting of the intake valve relative to the cylinder axis, and hence intake ports can be formed in a rectilinear shape generally parallel to the cylinder axis.

DETAILED DESCRIPTION

Figure 2:
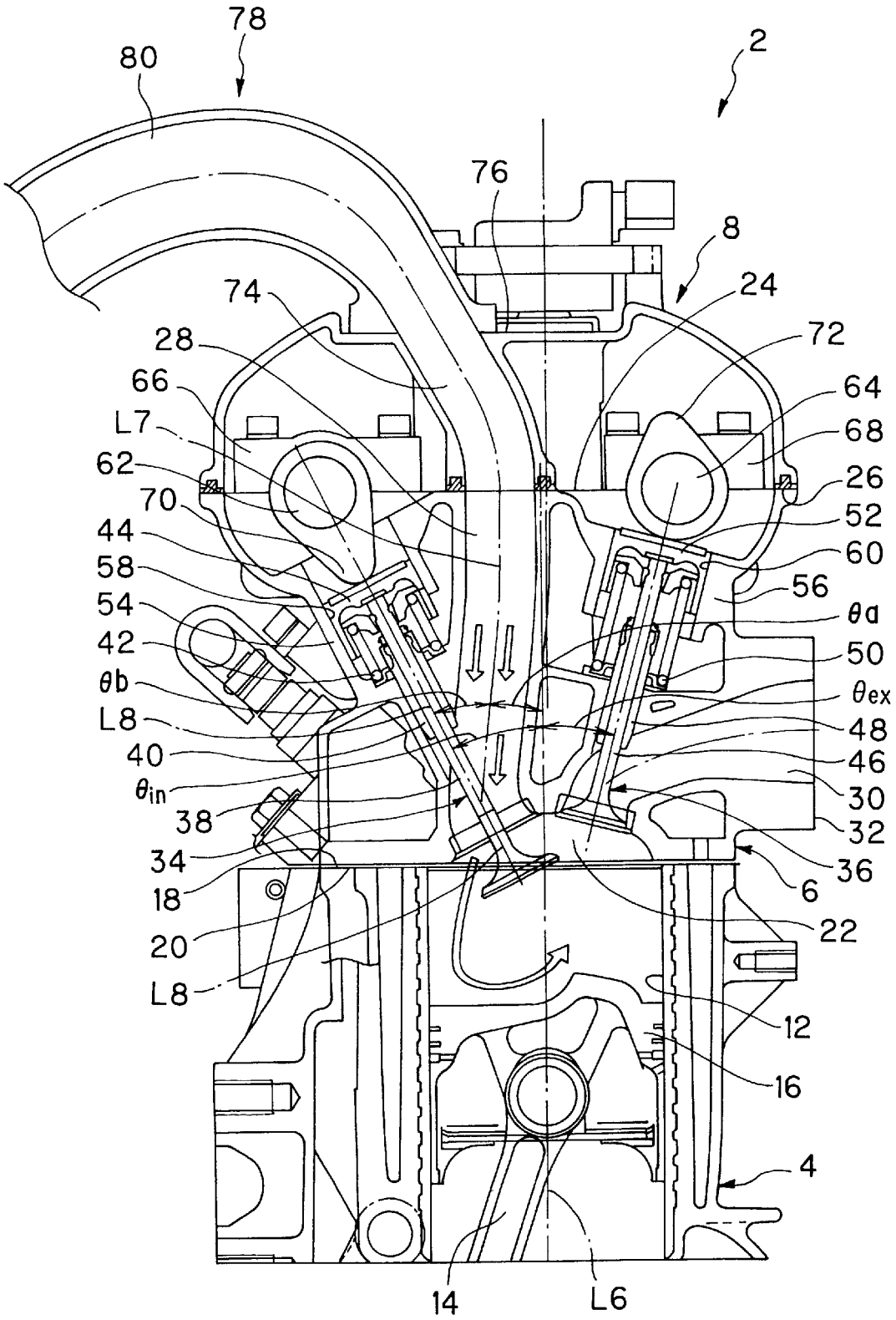
FIG. 2 is an enlarged sectional view of the FIG. 1 cylinder head.
Figure 3:
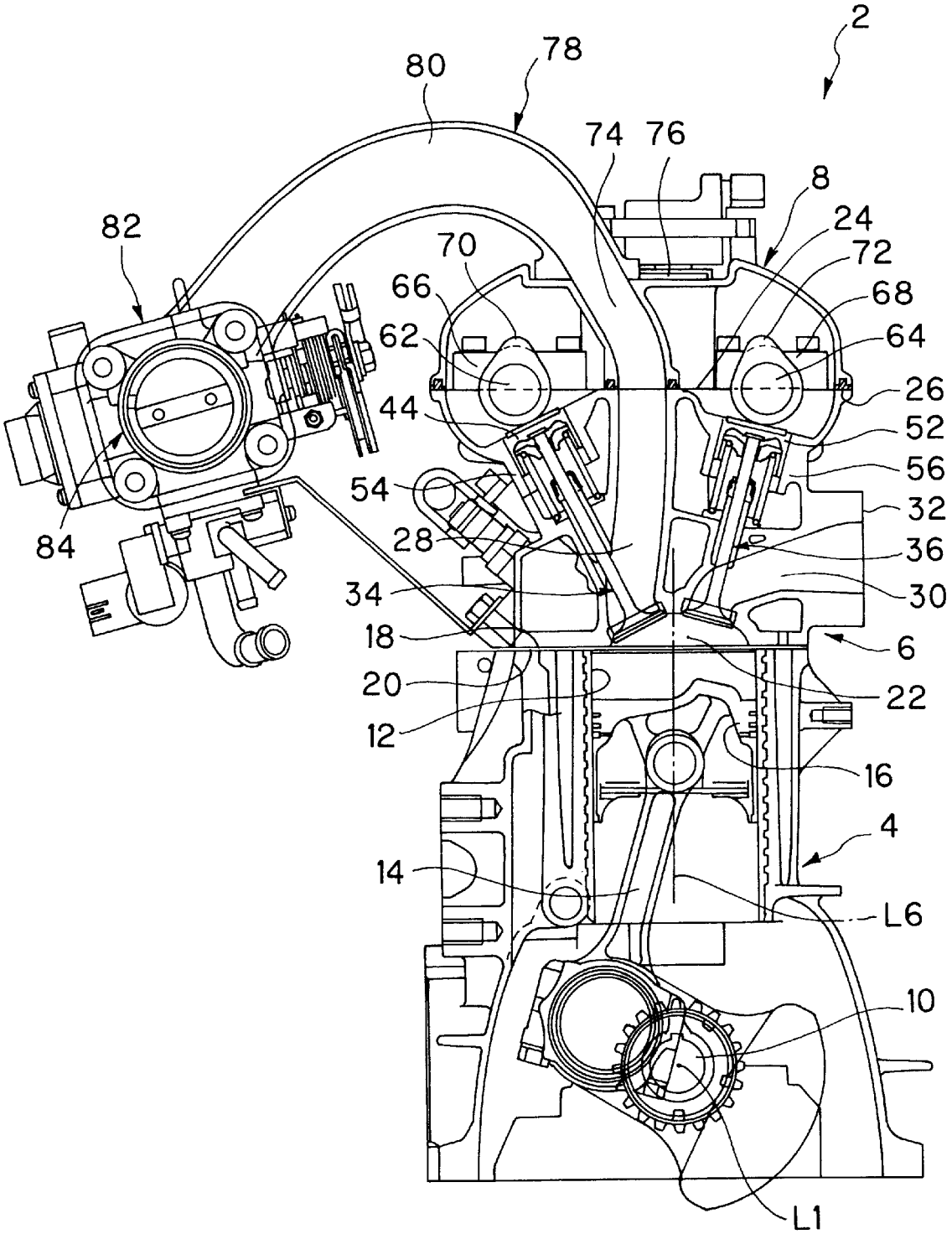
FIG. 3 is a sectional view of the internal combustion engine.
Figure 4:
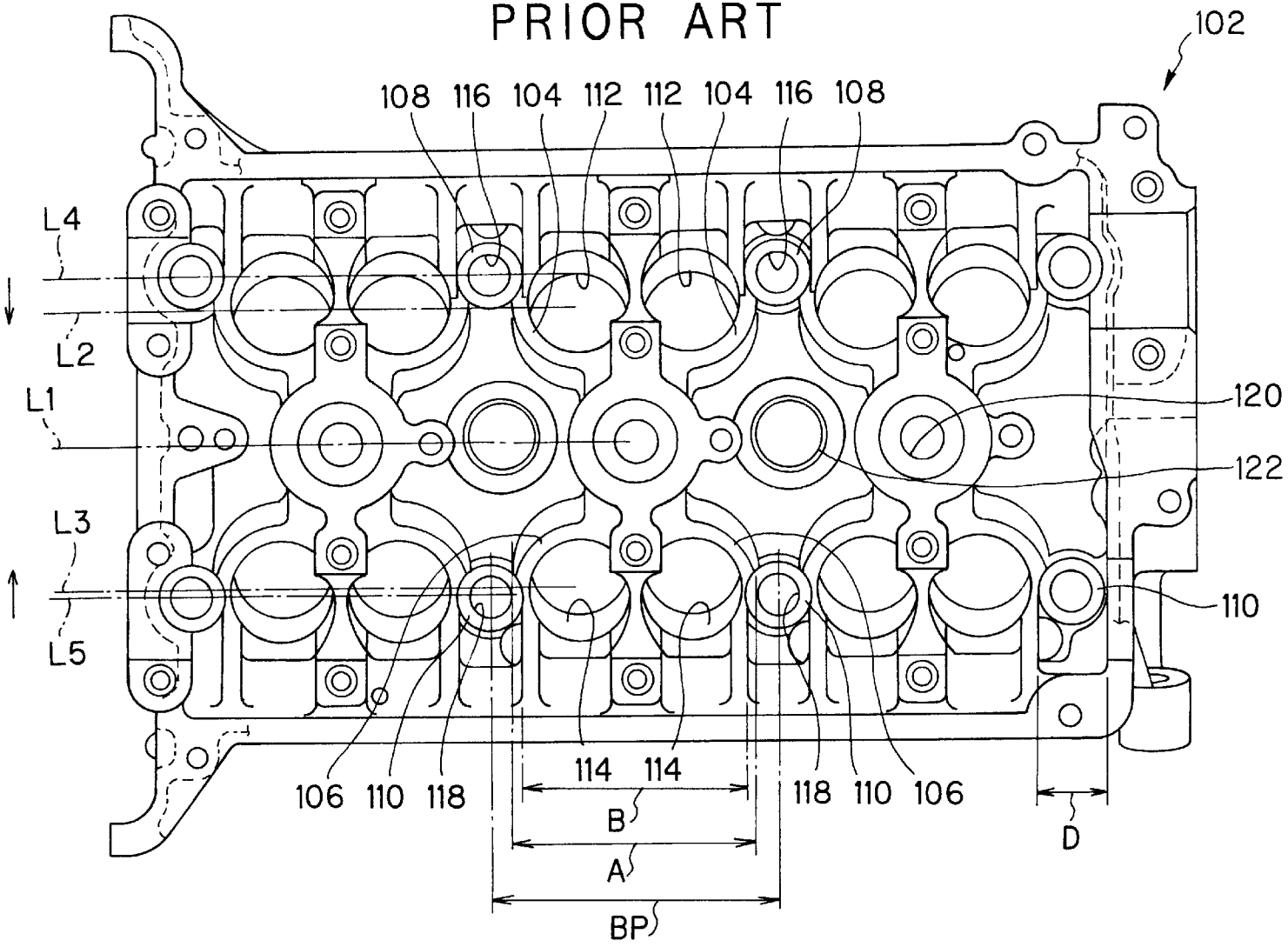
FIG. 4 PRIOR ART
FIG. 4 is a plan view of a conventional cylinder head of an internal combustion engine.
Figure 5:
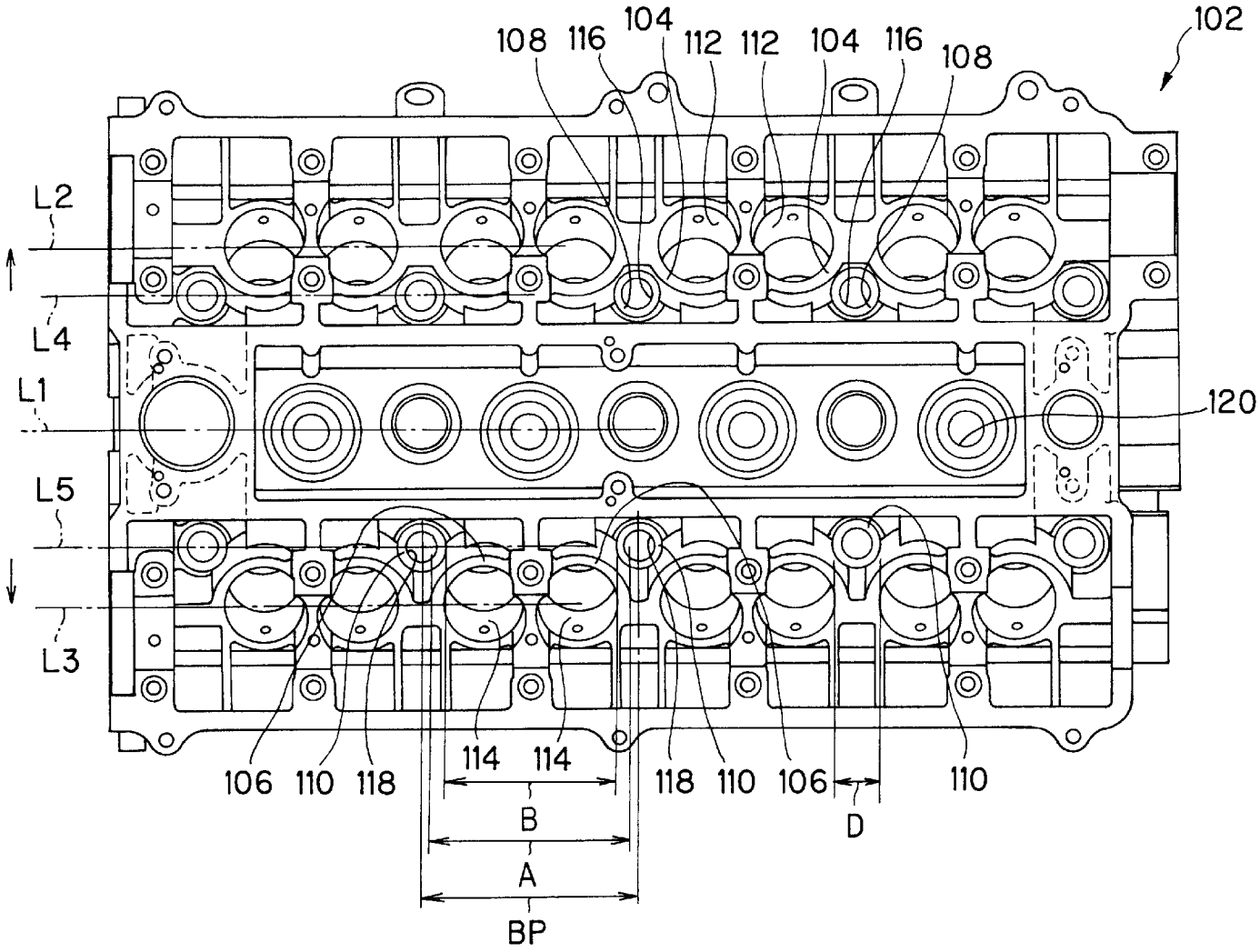
FIG. 5 PRIOR ART
FIG. 5 is a plan view of another conventional cylinder head of an internal combustion engine.

An embodiment of the present invention will now be described with reference to FIGS. 1 to 3. In FIGS. 2 and 3, the numeral 2 denotes an internal combustion engine, numeral 4 denotes a cylinder block, numeral 6 a cylinder head, and numeral 8 a cylinder head cover. A crankshaft 10 is supported below the cylinder block 4, while above the cylinder block 4 a plurality of cylinders 12 are arranged in the direction of a crank axis L1. Pistons 16 are connected to the crankshaft 10, which pistons 16 reciprocate within the cylinders 12 by means of connecting rods 14.

The cylinder head 6 is fixed onto the cylinder block 4 while a lower surface 20 thereof is brought into abutment with an upper surface 18 of the cylinder block 4. A combustion chamber 22 is formed by the cylinder block 4, cylinder head 6 and each piston 16. The cylinder head cover 8 is fixed to the cylinder head 6 while a surface 26 thereof is brought into abutment with an upper surface 24 of the cylinder head 6.

Intake ports 28 and exhaust ports 30 are formed in the cylinder head 6 for each cylinder 12, which ports 28 and 30 are in communication with the combustion chamber 22. The intake ports 28 are positioned on an intake side, which is one transverse side with respect to a cylinder axis L6 of the cylinder head 6. Two intake ports 28 are provided for each combustion chamber 22. Each intake port 28 is formed in a generally rectilinear shape so that one end thereof communicates with the combustion chamber 22, while the opposite end opens at the upper surface 24 of the cylinder head. The exhaust ports 30 are positioned on an exhaust-side opposite the intake side, with respect to the cylinder axis L6 of the cylinder head 6. Two exhaust ports 30 are provided for each combustion chamber 22. One end of each exhaust port 30 communicates with the combustion chamber 22, while the opposite end opens at a side face 32 of the cylinder head.

Intake valves 34 and exhaust valves 36 are mounted in the cylinder head 6 for opening and closing the intake ports 28 and the exhaust ports 30, respectively. Each intake valve 34 is held so that an intake stem 38 thereof is movable axially along an intake stem guide 40. The intake valve 34 is urged in its closing direction by means of an intake spring 42, and an intake tappet 44 is provided at the upper end of stem 38. Each exhaust valve 36 is held so that an exhaust stem 46 thereof is movable axially along an exhaust stem guide 48. The exhaust valve 36 is urged in its closing direction by means of an exhaust spring 50, and an exhaust tappet 52 is provided at the upper end of stem 46.

Intake-side tappet boss portions 54 and exhaust-side tappet boss portions 56 are formed in the cylinder head 6 to axially movably support the intake tappets 44 and the exhaust tappets 52, respectively. Intake-side tappet holes 58 and exhaust-side tappet holes 60 are formed in the intake-side tappet boss portions 54 and the exhaust-side tappet boss portions 56, respectively.

An intake camshaft 62 and an exhaust camshaft 64 are rotatably mounted in the upper surface 24 of the cylinder head 6 in such a manner that they are supported by an intake camshaft cap 66 and an exhaust camshaft cap 68, respectively. Intake cams 70 on the intake camshaft 62 and exhaust cams 72 on the exhaust camshaft 64 function to open and close the intake valves 34 and exhaust valves 36 by means of the intake tappets 44 and exhaust tappets 52, respectively.

Intake holes 74 are formed in the cylinder head cover 8 attached to the cylinder head 6, which intake holes 74, at one end thereof are in communication with the intake ports 28. The opposite end of the intake holes 74 open at an upper surface 76 of the head cover 8.

A downstream side of an intake manifold 78 is attached to the upper surface 76 of the cylinder head cover 8. The intake manifold 78 forms a manifold intake passage 80 communicating with the intake holes 74 of the cylinder head cover 8. On the opposite end side of the intake manifold 78 is disposed a surge tank 82, which surge tank 82 is provided with a throttle body 84.

Figure 1:
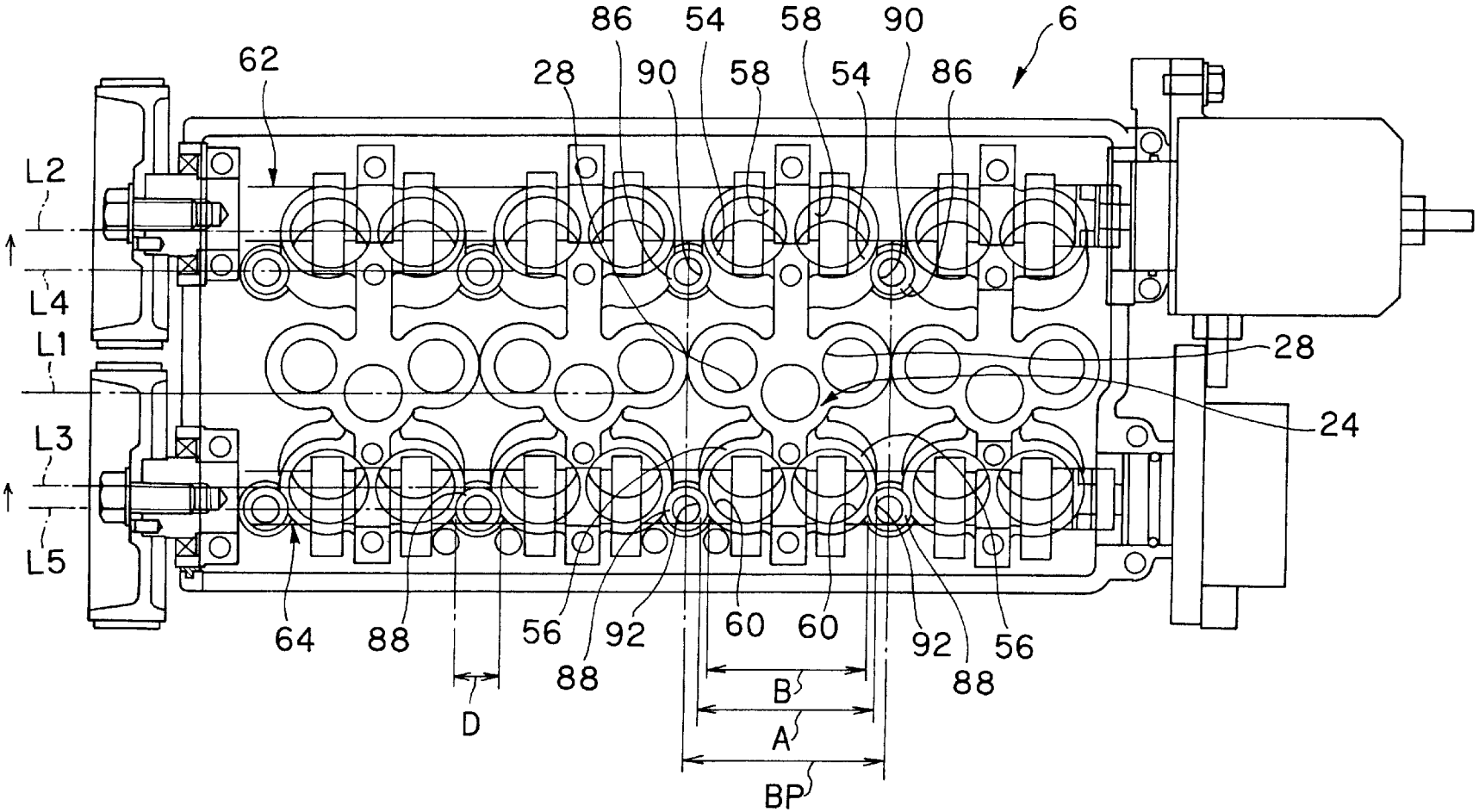
FIG. 1 is a plan view of a cylinder head of an internal combustion engine according to an embodiment of the present invention.

In the cylinder head 6, as shown in FIG. 1, intake-side bolt boss portions 86 and exhaust-side bolt boss portions 88 are formed, into which intake-side head bolts and exhaust-side head bolts (not shown), are inserted therein, respectively. The intake-side bolt boss portions 86 and the exhaust-side bolt boss portions 88 are adjacently positioned on both sides of the intake-side tappet boss portions 54 and the exhaust-side tappet boss portions 56, respectively, in the direction of the crank axis L1.

Intake-side bolt insertion holes 90 and exhaust-side bolt insertion holes 92 are formed in the intake-side bolt boss portions 86 and the exhaust-side bolt boss portions 88, respectively, and intake-side head bolts and exhaust-side head bolts (not shown) for mounting the cylinder head 6 to the cylinder block 4 are inserted into the bolt insertion holes 90 and 92, respectively.

In the cylinder head 6, the bolt pitch (BP) of the intake-side bolt boss portions 86 and of the exhaust-side bolt boss portions 88 are small, so that an innermost edge distance B of the intake-side bolt boss portions 86 and that of the exhaust-side bolt boss portions 88 are smaller than an outermost edge distance A of the intake-side tappet boss portions 54 and that of the exhaust-side tappet boss portions 56 (i.e. A>B). D represents the diameter of the intake-side bolt boss portions 86 and the exhaust-side bolt boss portions 88, and thus B=BP−D.

In the cylinder head 6, therefore, if the intake-side tappet boss portions 54 and the intake-side bolt boss portions 86 are positioned coaxially in parallel with the crank axis L1, and likewise if the exhaust-side tappet boss portions 56 and the exhaust-side bolt boss portions 88 are positioned coaxially in parallel with the crank axis L1, the intake-side tappet holes 58 and the intake-side bolt insertion holes 90 would interfere with each other, and likewise the exhaust-side tappet holes 60 and the exhaust-side bolt insertion holes 92 would interfere with each other.

To avoid this inconvenience, in the cylinder head 6, the intake-side tappet boss portions 54 are positioned outside the intake-side bolt boss portions 86 in the transverse direction of the cylinder head 6, and the exhaust-side tappet boss portions 56 are positioned inside the exhaust-side bolt boss portions 88 in the transverse direction of the cylinder head 6.

Further, the angle θ in of each intake valve 34 relative to the cylinder axis L6 of the internal combustion engine 2 is set larger than the angle θ ex of each exhaust valve 36 relative to the cylinder axis L6.

The structure and advantages of this embodiment will be summarized below.

In the cylinder head 6 of the internal combustion engine 2 are formed the intake-side tappet boss portions 54 and exhaust-side tappet boss portions 56 and also are formed the intake-side bolt boss portions 86 and exhaust-side bolt boss portions 88. The intake and exhaust-side bolt boss portions 86, 88 are positioned on both sides of the intake-side tappet boss portions 54 and exhaust-side tappet boss portions 56, respectively, adjacently in the direction of the crank axis L1. In the cylinder head 6, since the pitch or spacings BP between the intake-side bolt boss portions 86 and between the exhaust-side bolt boss portions 88 are small, the innermost edge distances B between the adjacent intake-side bolt boss portions 86 and between the adjacent exhaust-side bolt boss portions 88 are smaller than the outermost edge distances A between the adjacent intake-side tappet boss portions 54 and between the adjacent exhaust-side tappet boss portions 56 (i.e. A>B).

As such, the axis L2 joining the centers of the intake tappet boss portions 54 is positioned outside the axis L4 joining the centers of the intake-side bolt boss portions 86 in the transverse direction of the cylinder head; the intake-side tappet boss portions 54 are positioned outside the intake-side bolt boss portions 86 in the transverse direction of the cylinder head 6; the axis L3 joining the centers of the exhaust tappet boss portions 56 is positioned inside the axis L5 joining the centers of the exhaust-side bolt boss portions 88 in the transverse direction of the cylinder head; the exhaust-side tappet boss portions 56 are positioned inside the exhaust-side bolt boss portions 88 in the transverse direction of the cylinder head 6; and the angle θ in of each intake valve 34 relative to the cylinder axis L6 is set larger than the angle θ ex of each exhaust valve 36 relative to the axis L6.

Thus, since the intake-side tappet boss portions 54 are positioned outside the intake-side bolt boss portions 86 in the transverse direction of the cylinder head 6, it is possible to easily ensure a space for forming the intake ports 28 on the upper surface 24 of the cylinder head 6.

In the cylinder head 6, since the exhaust-side tappet boss portions 56 are positioned inside the exhaust-side bolt boss portions 88 in the transverse direction of the cylinder head 6, the exhaust-side of the engine 2 can be formed compactly.

Consequently, it is possible to ensure a space for forming the intake ports 28 on the upper surface 24 of the cylinder head 6 while keeping small the pitch BP of head bolts (not shown) to be used for mounting the cylinder head 6 to the cylinder block 4, and hence it is possible to easily ensure a mounting space for the intake manifold 78.

According to the structure of the cylinder head 6 in the internal combustion engine 2, the overall length of the engine 2 can be shortened because the head bolt pitch BP can be made small, and the exhaust-side width of the engine 2 can be made small because the exhaust-side tappet boss portions 56 are positioned inside the exhaust-side bolt boss portions 88 in the transverse direction of the cylinder head, whereby the engine 2 can be made compact.

In the cylinder head 6, moreover, the intake-side tappet boss portions 54 are positioned outside the intake-side bolt boss portions 86 in the transverse direction of the cylinder head to ensure a space for forming the intake ports 28 on the upper surface 24 of the cylinder head, and at the same time the angle θ in of each intake valve 34 relative to the cylinder axis L6 is set larger than the angle θ ex of each exhaust valve 36 relative to the cylinder axis L6. Consequently, the intake valve 34 can tilt largely with respect to the cylinder axis L6, thus permitting easy layout of the intake port 28, and it becomes possible to form the intake ports 28 in a rectilinear shape such that the intake ports 28 extend nearly parallel to the cylinder axis L6.

In the cylinder head 6, the intake-side tappet boss portions 54 are positioned outside the intake-side bolt boss portions 86 in the transverse direction of the cylinder head 6, the exhaust-side tappet boss portions 56 are positioned inside the exhaust-side bolt boss portions 88 transversely of the cylinder head 6, and the angle θ in of each intake valve 34 is set larger than the angle θ ex of each exhaust valve 36.

In this case, if the angle between the cylinder axis L6 and an axis L7 of each intake port 28 is assumed to be θ a and the angle between the intake port axis L7 and an axis L8 of each intake valve 34 is assumed to be θ b, since θ b is almost constant, the angle θ a becomes smaller as the intake valve angle θ in becomes larger.

As the angle θ a of each intake port 28 relative to the cylinder axis L6 becomes smaller, the intake port becomes straight, that is, it becomes rectilinear toward the upper surface 24 of the cylinder head and thus approaches an upright state.

In the cylinder head 6, therefore, the intake valves 34 tilt largely with respect to the cylinder axis L6, so that the layout of the intake ports 28 becomes easy and it is possible to form the intake ports 28 in a rectilinear shape so as to be nearly parallel to the cylinder axis L6.

Thus, according to the structure of the cylinder head 6 in the internal combustion engine 2, it is possible to introduce air smoothly into the combustion chamber 22 and there accrue an advantage in point of performance of the engine 2; besides, the radius of curvature of the intake manifold 78 can be set large, which is also advantageous in the layout of the intake manifold 78.

In the cylinder head structure of the internal combustion engine 2 according to the present invention, as set forth hereinabove, it is possible to ensure a space for forming intake ports 28 on the upper surface 24 of the cylinder head 6 while keeping small the pitch of head bolts for mounting the cylinder head 6 to the cylinder block 4, and the mounting space for the intake manifold 78 can be easily ensured.

Since the head bolt pitch can thus be set small, it is possible to shorten the overall length of the internal combustion engine 2. In addition, the exhaust-side tappet boss portions 56 are positioned inside the exhaust-side bolt boss portions 88 transversely of the cylinder head 6, so that the exhaust-side width of the engine can be made small, whereby the engine can be rendered compact.

Further, since the intake valves 34 tilt largely with respect to the cylinder axis L6, the layout of intake ports 28 becomes easy and it is possible to form the intake ports 28 in a rectilinear shape nearly parallel to the cylinder axis L6.

Consequently, it is possible to introduce air smoothly into each combustion chamber 22, which is advantageous in point of performance of the internal combustion engine 2; and the radius of curvature of the intake manifold 78 can be large, which is advantageous to the layout of the intake manifold 78.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a cylinder head structure of an internal combustion engine including:

intake ports opening in an upper surface of a cylinder head, said intake ports being in communication with a combustion chamber;

exhaust ports opening in a side face of the cylinder head, said exhaust ports being in communication with the combustion chamber;

intake valves and exhaust valves for opening and closing the intake ports and the exhaust ports, respectively, said intake valves and said exhaust valves being mounted in the cylinder head;

intake-side tappet boss portions and exhaust-side tappet boss portions formed in the cylinder head, said intake-side tappet boss portions and said exhaust-side tappet boss portions respectively axially movably supporting intake tappets and exhaust tappets for the intake valves and the exhaust valves; and intake-side bolt boss portions and exhaust-side bolt boss portions formed in the cylinder head for insertion therein of intake-side head bolts and exhaust-side head bolts, respectively, said intake-side bolt boss portions and said exhaust-side bolt boss portions being adjacently positioned respectively on both sides of the intake-side tappet boss portions and the exhaust-side tappet boss portions in an axial direction of a crankshaft;

comprising the improvement wherein said intake-side tappet boss portions are positioned outside said intake-side bolt boss portions in the transverse direction of the cylinder head, and said exhaust-side tappet boss portions are positioned inside said exhaust-side bolt boss portions in the transverse direction of the cylinder head.

2. The cylinder head structure of an internal combustion engine according to claim 1 wherein, in said cylinder head, the angle of each said intake valve relative to a cylinder axis is larger than the angle of each said exhaust valve relative to said cylinder axis.

3. A cylinder head arrangement for an internal combustion engine having a crankshaft defining a crankshaft axis, said cylinder head arrangement comprising:

a cylinder head and a cylinder block together defining at least one combustion chamber, said cylinder head having a longitudinal axis generally parallel with a longitudinal axis of the crankshaft and dividing said cylinder head into an intake side and an exhaust side;

a plurality of intake and exhaust ports disposed in said cylinder head at said intake side and said exhaust side, respectively, and communicating with said combustion chamber, said intake ports opening at an upper surface of said cylinder head and said exhaust ports opening at a side surface of said cylinder head;

a plurality of intake valves mounted in said cylinder head to open and close said intake ports, and a plurality of exhaust valves mounted in said cylinder head to open and close said exhaust ports, each said intake valve and exhaust valve having a tappet portion disposed at one end thereof;

a plurality of intake tappet boss portions disposed in said cylinder head at said intake side and configured for axially movably supporting said tappet portions of said intake valves, and a plurality of exhaust tappet boss portions disposed in said cylinder head at said exhaust side and configured for axially movably supporting said tappet portions of said exhaust valves;

a plurality of intake bolt boss portions and exhaust bolt boss portions disposed in said cylinder head at said intake side and said exhaust side, respectively, and configured for receiving a bolt for fixing said cylinder head to said cylinder block;

said intake tappet boss portions being disposed a first distance from the cylinder head axis, said intake bolt boss portions being disposed a second distance from the cylinder head axis, said second distance being less than said first distance; and said exhaust tappet boss portions being disposed a third distance from the cylinder head axis, said exhaust bolt boss portions being disposed a fourth distance from the cylinder head axis, said fourth distance being greater than said third distance.

4. The cylinder arrangement of claim 3 wherein said intake tappet boss portions are disposed in pairs axially along said cylinder head with one said intake bolt boss portion being disposed between each pair of intake tappet boss portions, and said exhaust tappet boss portions are disposed in pairs axially along said cylinder head with one said exhaust bolt boss portion being disposed between each pair of exhaust tappet boss portions.

5. The cylinder arrangement of claim 3 further including at least one cylinder disposed in said cylinder block and defining a portion of said combustion chamber, said cylinder having a longitudinal axis transverse to the cylinder head axis, said intake valves and said exhaust valves being disposed at an angle with respect to the cylinder axis, said angle of said intake valves being substantially greater than said angle of said exhaust valves.

6. The cylinder arrangement of claim 5 wherein said intake ports extend substantially linearly through said cylinder head and substantially parallel to the cylinder axis to enable smooth introduction of air into said combustion chamber.

* * * * *